US006988562B2

(12) United States Patent
Hecht

(10) Patent No.: US 6,988,562 B2
(45) Date of Patent: Jan. 24, 2006

(54) MANUAL MACHINE TOOL

(75) Inventor: Joachim Hecht, Magstadt (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/415,568

(22) PCT Filed: Jun. 26, 2002

(86) PCT No.: PCT/DE02/02322

§ 371 (c)(1),
(2), (4) Date: Apr. 29, 2003

(87) PCT Pub. No.: WO03/035329

PCT Pub. Date: May 1, 2003

(65) Prior Publication Data

US 2004/0026097 A1 Feb. 12, 2004

(30) Foreign Application Priority Data

Oct. 5, 2001 (DE) ..... 101 49 216

(51) Int. Cl.
*E02D 7/14* (2006.01)

(52) U.S. Cl. ..... 173/48; 173/49

(58) Field of Classification Search ..... 173/15, 173/48, 49, 94, 109, 117, 118, 124
See application file for complete search history.

(56) References Cited

U.S. PATENT DOCUMENTS

| | | | | |
|---|---|---|---|---|
| 1,841,351 A | | 1/1932 | Trotter | |
| 2,646,100 A | | 7/1953 | Gibson | |
| 3,841,418 A | * | 10/1974 | Biersack | 173/109 |
| 4,325,436 A | * | 4/1982 | Richter et al. | 173/13 |
| 4,641,714 A | * | 2/1987 | Ferioli | 173/109 |
| 4,895,212 A | * | 1/1990 | Wache | 173/48 |

FOREIGN PATENT DOCUMENTS

| | | |
|---|---|---|
| DE | 28 39 906 A | 3/1980 |
| DE | 32 15 198 A | 10/1983 |
| DE | 41 21 279 A | 1/1993 |
| DE | 197 26 383 A | 12/1998 |
| DE | 100 41 410 A | 7/2001 |
| EP | 0 345 896 A | 12/1989 |
| EP | 0 477 576 A | 4/1992 |

* cited by examiner

*Primary Examiner*—Louis K. Huynh
*Assistant Examiner*—Chukwurah Nathaniel

(57) ABSTRACT

The invention is based on a hand power tool, having a drive shaft (12, 14) supported in the housing (10) and having a mechanical percussion mechanism (16, 18, 20, 22, 24), which has a striker (26, 28) that is driven in hammering fashion via a driver unit (32, 34) supported on an intermediate shaft (30), which driver unit has at least one curve element (36, 38) by way of which at least one transmission unit (40, 42, 44, 46) with a tracer member is movable.

It is proposed that the curve element (36, 38) has at least one first and at least one second curved path segment (56, 58, 60, 62), the first curved path segment acting in a first axial direction of the intermediate shaft (30) and the second curved path segment acting in a second axial direction of the intermediate shaft (30).

9 Claims, 4 Drawing Sheets

MANUAL MACHINE TOOL

BACKGROUND OF THE INVENTION

The invention is based on a hand power tool.

From German Patent Disclosure DE 41 21 279 A1, a drilling jackhammer with a drive shaft supported in a housing and with a mechanical percussion mechanism is known. The percussion mechanism has a striker, supported in the drive shaft embodied as a hollow shaft, and the striker is driven in hammering fashion via a driver unit supported on an intermediate shaft. The driver unit has a curve element, disposed on the intermediate shaft, that is embodied as an eccentric element and has an eccentricity in the radial direction. Via the eccentric element, a transmission unit that has a tracer member and is connected to the striker is movable. The tracer member is formed by a needle bearing, whose outer ring is formed by an articulation sleeve that surrounds the eccentric element. The articulation sleeve has a downward-oriented extension in which there is an opening.

A transmission member formed by a spring reaches with its first leg through the opening in the articulation sleeve. The transmission member is tiltably supported about a shaft structurally connected to the housing, and with its second, hooplike leg it surrounds the striker.

When the intermediate shaft is rotating, the tracer member and the first leg of the transmission member are moved in the radial direction by the motion of the eccentric element. Via the shaft structurally connected to the housing, the radial motion of the first leg is converted into an axial motion of the second leg, and the striker is driven in the axial direction.

SUMMARY OF THE INVENTION

The invention is based on a hand power tool, having a drive shaft supported in the housing and having a mechanical percussion mechanism, which has a striker that is driven in hammering fashion via a driver unit supported on an intermediate shaft, which driver unit has at least one curve element by way of which at least one transmission unit with a tracer member is movable. It is provided that the curve element has at least one first and at least one second curved path segment, the first curved path segment acting in a first axial direction of the intermediate shaft and the second curved path segment acting in a second axial direction of the intermediate shaft. Advantageously, the transmission unit can be moved in the axial direction directly via the tracer member, making it possible to avoid some components, and in particular a deflection mechanism for converting a radial motion into an axial motion. A percussion mechanism that is especially simple to preassemble can also be attained, along with an especially compact hand power tool.

Because of the disposition of the driver unit on the intermediate shaft, an existing gear stage can be used to adjust a number of impacts of the striker per revolution of the spindle, and an advantageous and in particular time-tested notch pattern can always be attained.

If the striker is supported via the drive shaft, then a space-saving design can be achieved in which additional components, in particular a shaft, oriented coaxially with the drive shaft, for supporting the striker, can be avoided. Time-tested standard components can largely be kept, and complicated new constructions can be avoided. It is also proposed that the striker is supported with a formed-on guide face on a guide face of the drive shaft, or directly on the drive shaft. Additional bearing components can be avoided, and a construction that is compact in the radial direction can be achieved.

The striker can be supported on or in the drive shaft. If the striker is guided in the drive shaft, then an embodiment according to the invention that can be employed in a drill hammer and/or jackhammer can be achieved.

If the tracer member is embodied as a spring element, additional spring elements can be dispensed with. However, especially advantageously, the tracer member is connected to the striker via a spring element, in particular making a space-saving construction in the radial direction possible.

The spring element can be formed of an elastic rubber element or some other spring element that appears appropriate to one skilled in the art. However, if the spring element is embodied by a helical compression spring that advantageously surrounds the striker, then a structurally simple, economical, space-saving percussion mechanism that is simple to assemble is achievable.

Especially advantageously, the tracer member is displaceably supported on the striker. The axial motion of the driver unit can be transmitted structurally simply to the striker, making economies in terms of both components and installation space possible. Fundamentally, however, it is also conceivable for the tracer member to be supported on a component that is separate from the striker, such as on the drive shaft, and so forth.

It is also proposed that the spring element is disposed radially inside the tracer member and is braced on a radially inward-pointing collar of the tracer member. An apparatus can be achieved in which the spring element is advantageously protected by the tracer member. If the inward-pointing collar of the tracer member engages the space between two windings of a single spring element, then the tracer member can move in both axial directions counter to the spring force of the single tracer member. This makes economies possible in terms of components, in particular a second spring element, as well as expenses.

In a further feature of the invention, it is proposed that the curve element be formed by a groove. A tracer member that has a disk can engage the groove, and a structurally simple transmission of motion that can be realized economically can be attained. However, the curve element can also be formed by an outer edge of a component, such as a swash plate and/or a wavy disk, and so forth.

The embodiment according to the invention can be used structurally simply in hand power tools that appear suitable to one skilled in the art, such as scrapers and so forth, but especially advantageously in percussion drills, drill hammers, and jackhammers.

Further advantages will become apparent from the ensuing description of the drawings. In the drawing, exemplary embodiments of the invention are shown. The drawing, description and claims include numerous characteristics in combination. One skilled in the art will expediently consider the characteristics individually as well and put them together to make useful further combinations.

DESCRIPTION OF PREFERRED EMBODIMENTS

Figure 1:
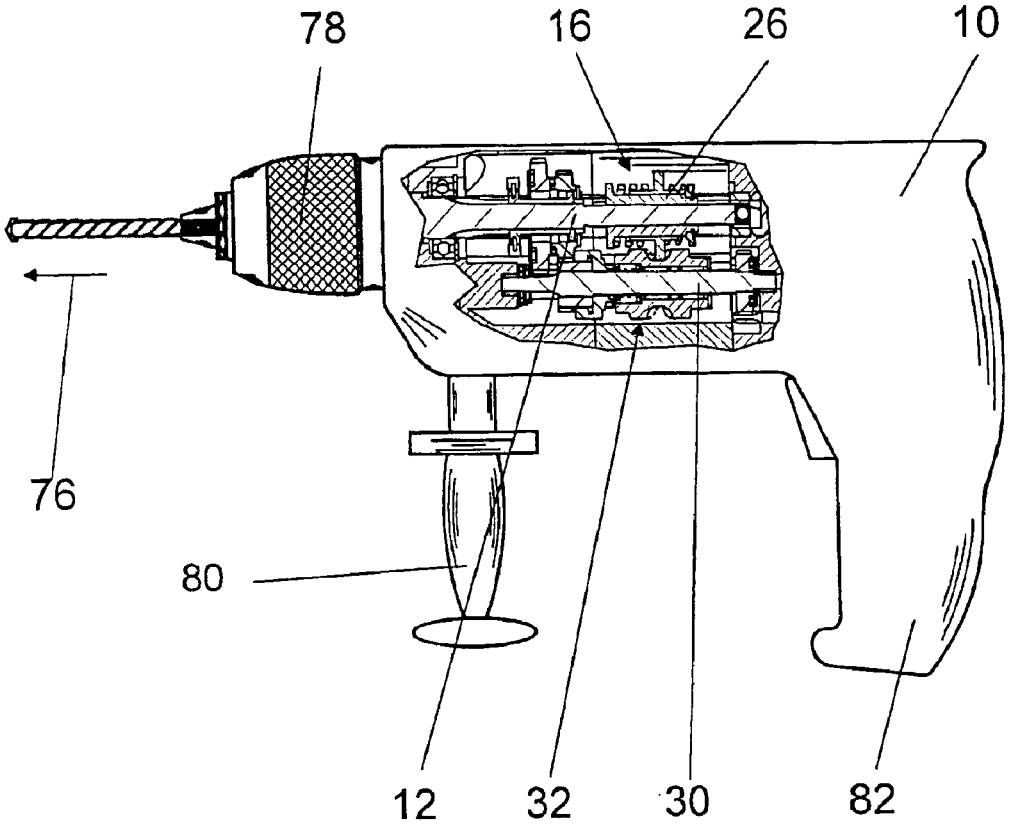
FIG. 1, a schematic illustration of a percussion drill.
Figure 2:
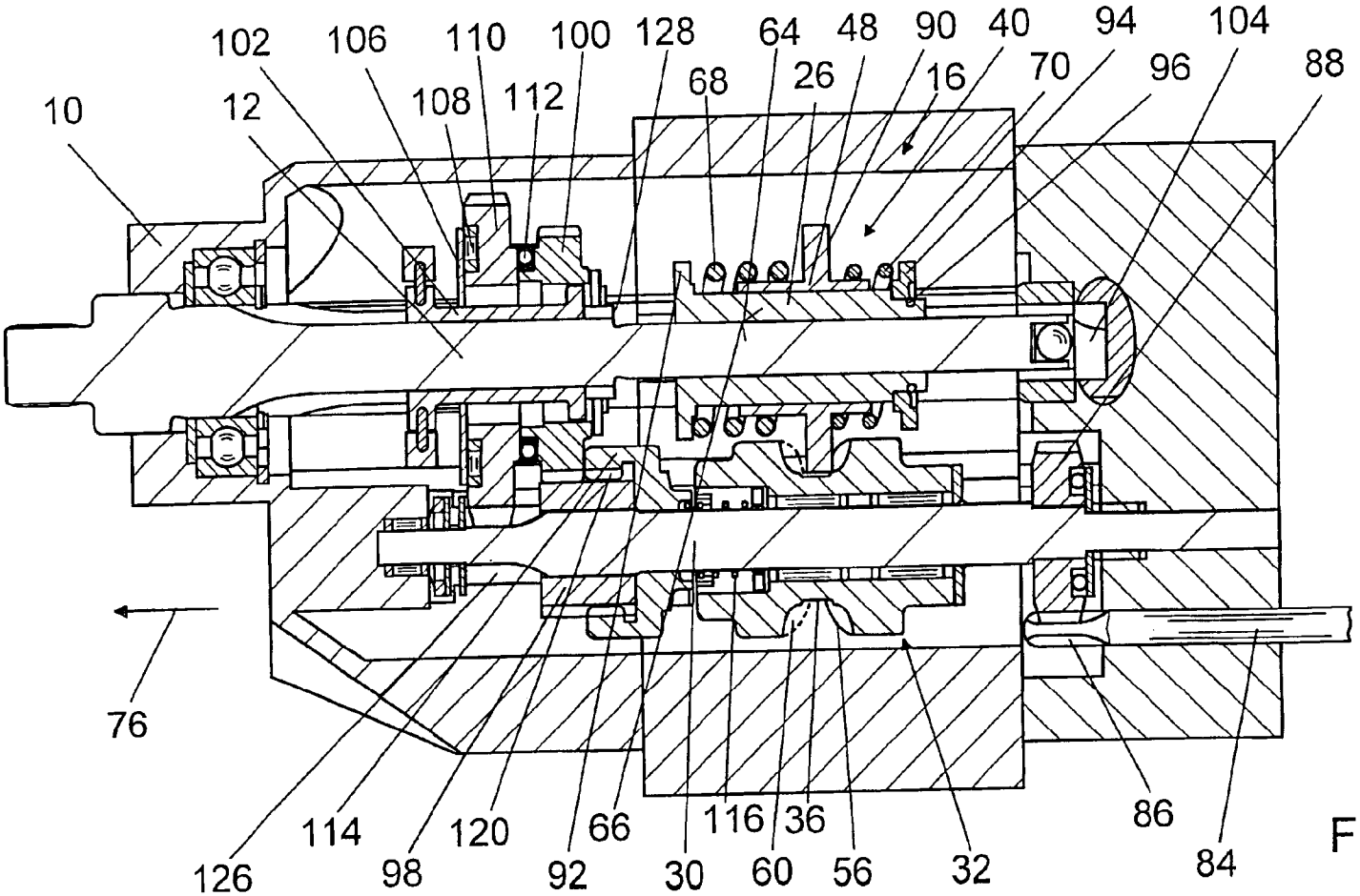
FIG. 2, a percussion mechanism of the invention, with a curve element that is formed by a groove.

FIGS. 1 and 2 schematically show a percussion drill, with an electric motor, not further shown, in a housing 10 along with a gear and a mechanical percussion mechanism 16, which has a sleevelike striker 26 which is supported on a drive shaft 12 and is guided, via a formed-on guide face 66, on a guide face 64 of the drive shaft 12.

Downstream of a tool receptacle 78 counter to an actuating direction 76, the percussion drill has a first grip 80, secured to the housing 10 and extending perpendicular to the actuating direction 76; on a side of the housing 10 remote from the tool receptacle 78, it also has a second grip 82, formed onto the housing 10 and extending perpendicular to the actuating direction 76.

The electric motor has an armature shaft 84, onto which a pinion 86 is formed (FIG. 2). The pinion 86 meshes with a spur gear 88 that is disposed, in a manner fixed against relative rotation, on a side of an intermediate shaft 30 remote from the tool receptacle 78. A driver unit 32 is supported on the intermediate shaft 30 and has a curve element 36. The curve element 36 is formed by a groove and has a first curved path segment 56, acting in a first axial direction of the intermediate shaft 30, and a second curved path segment 60, acting in a second axial direction of the intermediate shaft 30. Via the curve element 36, a tracer member 48 of a transmission unit 40 can be moved or driven. The tracer member 48 has a radially outward-pointing collar 90, which positively engages the groove of the curve element 36.

The sleevelike tracer member 48, supported displaceably on the striker 26, is operatively connected to the striker 26 via two spring elements 68, 70, formed by helical compression springs, that radially surround the tracer member 48 and the striker 26. The first spring element 68, counter to the actuating direction 76, is braced with its front end, pointing in the actuating direction 76, on a radially outward-pointing collar 92 of the striker 26 and is braced with its rear end, pointing counter to the actuating direction 76, on the collar 90 of the tracer member 48. The second spring element 70, counter to the actuating direction 76, is braced with its front end, pointing in the actuating direction 76, on the collar 90 of the tracer member 48 and by its rear end, pointing counter to the actuating direction 76, a disk 94, which is secured on the striker 26 counter to the actuating direction 76 via a securing ring 96.

Upon a rotary motion of the armature shaft 84, the pinion 86 of the armature shaft 84 meshes with the spur gear 88, by way of which the intermediate shaft 30 is driven to rotate. On the side toward the tool receptacle 78, the intermediate shaft 30 has a gear wheel 98, disposed in a manner fixed against relative rotation, and a formed-on pinion 126. The gear wheel 98 and the pinion 126 are each connected to a respective idler wheel 100, 110 supported on the drive shaft 12, and these idler wheels can be coupled to the drive shaft 12 via a coupling body 102. For switchover to a percussion mode, the drive shaft 12 can be released in its axial direction of motion via an eccentric element 104, which is located on a side of the drive shaft 12 remote from the tool receptacle 78 (FIG. 2).

If the percussion drill is switched to percussion mode, and if it is pressed with its tool against a surface to be machined, the drive shaft 12 is moved in the axial direction counter to the actuating direction 76, and a run-up disk 106 supported on the drive shaft 12 transmits the axial motion of the drive shaft 12, via an axial bearing 108, the idler wheel 110 and an axial bearing 112, to the idler wheel 100, which transmits its axial motion to a coupling sleeve 114. Via a set of internal teeth 120, the coupling sleeve 114 is connected to the gear wheel 98 and driven to rotate.

Because of the axial displacement on the intermediate shaft, the coupling sleeve 114, with its side remote from the tool receptacle 78, engages the driver unit 32 via cams, not shown in detail. The driver unit 32 is connected for driving to the intermediate shaft 30 via the coupling sleeve 114, the internal teeth 120 of the coupling sleeve 114, and the gear wheel 98.

The driver unit 32 connected in terms of driving to the intermediate shaft 30 deflects the tracer member 48 in the actuating direction 76, counter to the spring force of the spring element 68, by means of the first curved path segment 56 acting in the actuating direction 76. The spring element 68 is compressed in the actuating direction 76 by an inertia of the striker 26 and by the motion of the tracer member 48. An ensuing expansion of the spring element 68 accelerates the striker 26 in the actuating direction 76 toward the tool receptacle 78 and strikes a shoulder 128 formed onto the drive shaft 12.

The second curved path segment 60, projected into the visible plane and following the first curved path segment 56 and acting counter to the actuating direction 76 deflects the tracer member 48 counter to the actuating direction 76 and counter to a spring force of the spring element 70. The spring element 70 is compressed counter to the actuating direction 76 by an inertia of the striker 26 and by the motion of the tracer member 48. An ensuing expansion of the spring element 70 accelerates the striker 26 counter to the actuating direction 76.

If the user lifts the percussion drill from the surface to be machined, a spring element 116 presses the coupling sleeve 114 in the actuating direction 76. The connection between the coupling sleeve 114 and the driver unit 32 is broken and the percussion mode is stopped.

In FIGS. 3–6, further alternative percussion mechanisms 18, 20, 22, 24 are shown in fragmentary form. Components that remain essentially the same are identified by the same reference numerals throughout. For characteristics and functions that remain the same, reference may be made to the description of the exemplary embodiment in FIGS. 1 and 2. The following description will be limited essentially to the differences from the exemplary embodiment of FIGS. 1 and 2.

Figure 3:
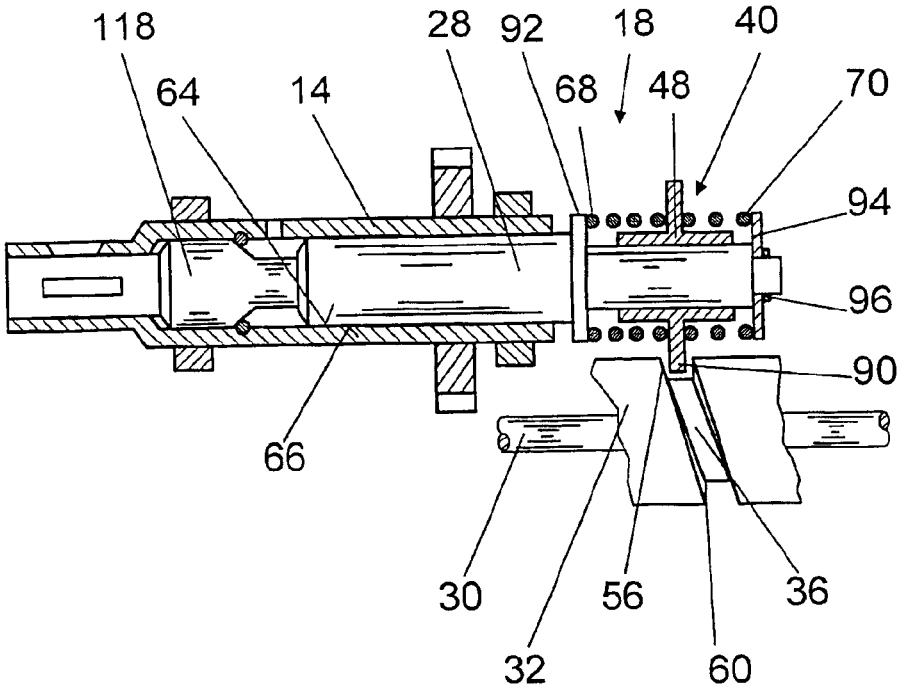
FIG. 3, the percussion mechanism of the invention shown in FIG. 2 for a drill hammer.

FIG. 3 shows a percussion mechanism 18 for a drill hammer whose striker 28 is guided in a drive shaft 14 that is embodied as a hollow shaft. If the striker 28 is accelerated in the actuating direction 76, it strikes a snaphead die 118, which in turn acts on a tool not shown further.

Figure 4:
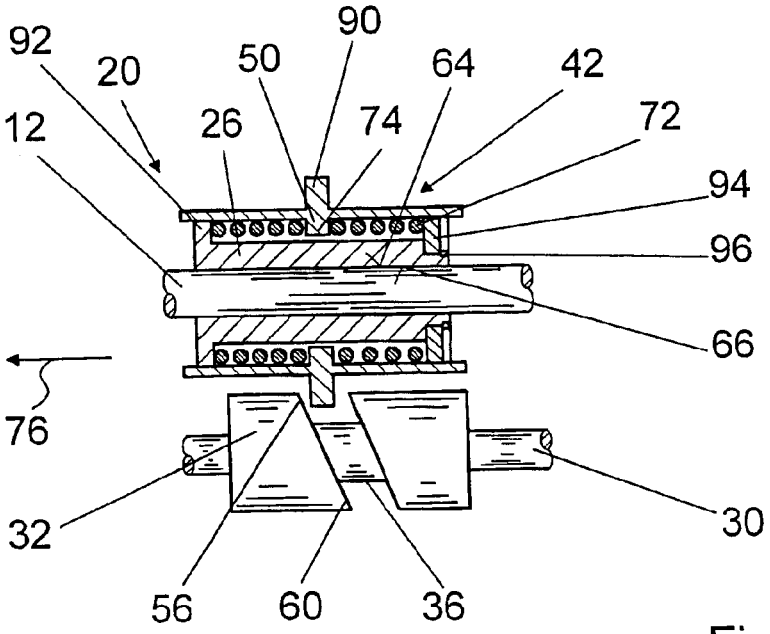
FIG. 4, a variant of the percussion mechanism of FIG. 2 in which a spring element is disposed radially inside a tracer member.

FIG. 4, compared to FIG. 2, shows an alternative percussion mechanism 20, in which a single spring element 72 is disposed in a radially inner region of a tracer member 50 of a transmission unit 42. The spring element 72 is braced by its front end, pointing in the actuating direction 76, on a radially outward-pointing collar 92 of a striker 26 and by its rear end, pointing counter to the actuating direction 76, on a disk 94, which is secured to the striker 26 counter to the actuating direction 76 via a securing ring 96. The tracer member 50 surrounds the striker 26, is supported on the striker 26 via the collar 92 of the striker 26 and via the disk 94, and is operatively connected to the striker 26 via a radially inward-pointing collar 74, which engages the space between windings of the spring element 72, and via the spring element 72 itself. Instead of a single spring element 72, two spring elements which are braced on the collar 74 are also conceivable.

Figure 5:
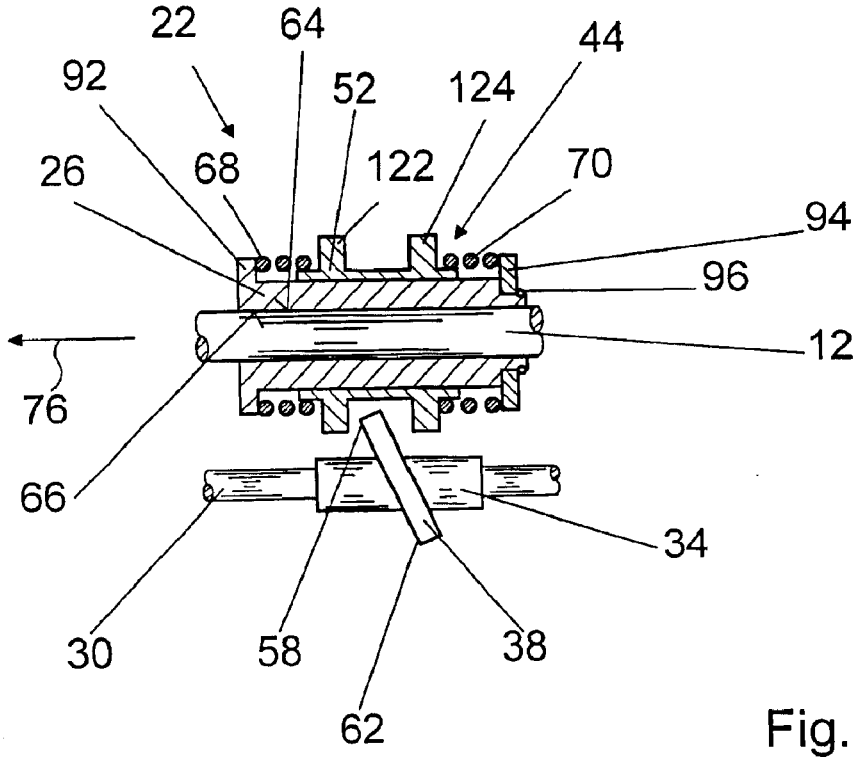
FIG. 5, a variant of the percussion mechanism of FIG. 2, with a curve element embodied as a swash plate.

FIG. 5 shows an alternative percussion mechanism 22 to FIG. 2, with a driver unit 34 which is supported on an intermediate shaft 30 and has a curve element 38. The curve element 38 is embodied as a swash plate. The curve element 38 positively engages the space between two radially outward-pointing collars 122, 124 of a tracer member 52 of a transmission unit 44 and moves the tracer member 52 via a first curved path segment 58, acting in the actuating direction 76, and via a second curved path segment 62, acting counter to the actuating direction 76.

Figure 6:
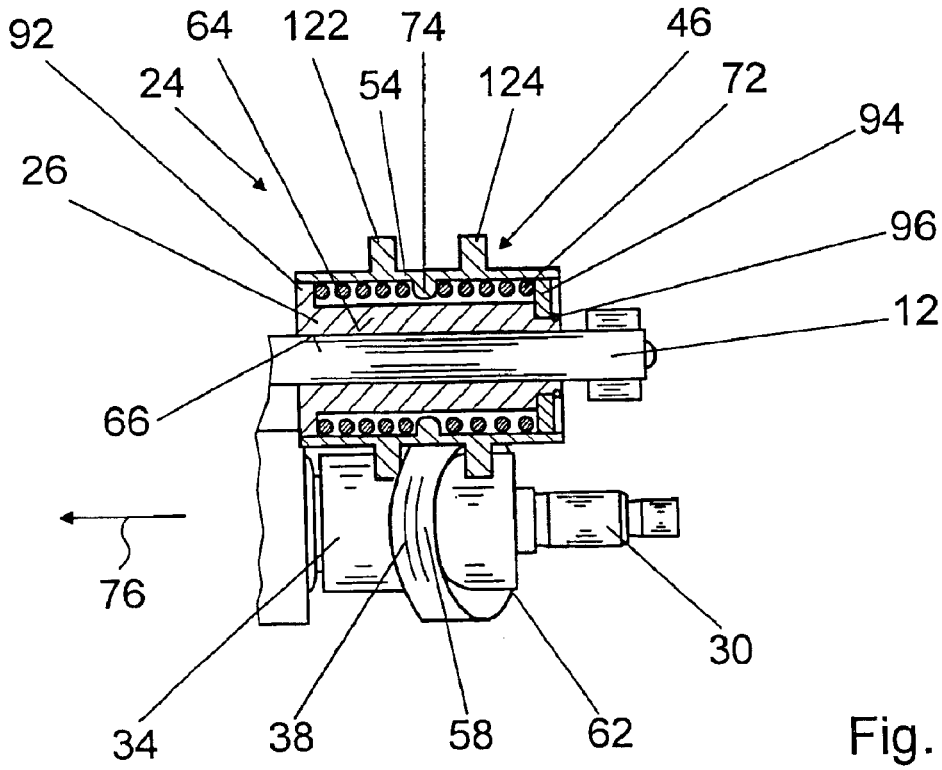
FIG. 6, a variant of the percussion mechanism of FIG. 5, in which the spring element is disposed radially inside the tracer member.

FIG. 6 shows a percussion mechanism 24 as an alternative to that of FIG. 5; in it, a single spring element 72 is disposed in a radially inner region of a tracer member 50 of a transmission unit 42, as in the exemplary embodiment of FIG. 4. The spring element 72 is braced by its front end, pointing in the actuating direction 76, on a radially outward-pointing collar 92 of a striker 26 and by its rear end, pointing counter to the actuating direction 76, on a disk 94, which is secured on the striker 26 counter to the actuating direction 76 via a securing ring 96. The tracer member 50 is operatively connected to the striker 26 via a radially inward-pointing collar 74, which engages the space between windings of the spring element 72, and via the spring element 72. Instead of a single spring element 72, two spring elements that are braced on the collar 74 are also conceivable.

LIST OF REFERENCE NUMERALS

| | |
|---|---|
| 10 | Housing |
| 12 | Drive shaft |
| 14 | Drive shaft |
| 16 | Percussion mechanism |
| 18 | Percussion mechanism |
| 20 | Percussion mechanism |
| 22 | Percussion mechanism |
| 24 | Percussion mechanism |
| 26 | Striker |
| 28 | Striker |
| 30 | Intermediate shaft |
| 32 | Driver unit |
| 34 | Driver unit |
| 36 | Curve element |
| 38 | Curve element |
| 40 | Transmission unit |
| 42 | Transmission unit |
| 44 | Transmission unit |
| 46 | Transmission unit |
| 48 | Tracer member |
| 50 | Tracer member |
| 52 | Tracer member |
| 54 | Tracer member |
| 56 | Curved path segment |
| 58 | Curved path segment |
| 60 | Curved path segment |
| 62 | Curved path segment |
| 64 | Guide face |
| 66 | Guide face |
| 68 | Spring element |
| 70 | Spring element |
| 72 | Spring element |
| 74 | Collar |
| 76 | Actuating direction |
| 78 | Tool receptacle |
| 80 | Grip |
| 82 | Grip |

-continued

| | |
|---|---|
| 84 | Armature shaft |
| 86 | Pinion |
| 88 | Spur gear |
| 90 | Collar |
| 92 | Collar |
| 94 | Disk |
| 96 | Securing ring |
| 98 | Gear wheel |
| 100 | Idler wheel |
| 102 | Coupling body |
| 104 | Eccentric element |
| 106 | Run-up disk |
| 108 | Axial bearing |
| 110 | Idler wheel |
| 112 | Axial bearing |
| 114 | Coupling sleeve |
| 116 | Spring element |
| 118 | Snaphead die |
| 120 | Internal toothing |
| 122 | Collar |
| 124 | Collar |
| 126 | Pinion |
| 128 | Shoulder |

What is claimed is:

1. A hand power tool, having a drive shaft (12, 14) supported in the housing (10) and having a mechanical percussion mechanism (16, 18, 20, 22, 24), which has a striker (26, 28) that is driven in hammering fashion via a driver unit (32, 34) supported on an intermediate shaft (30), which driver unit has at least one curve element (36, 38) by way of which at least one transmission unit (40, 42, 44, 46) with a tracer member is movable, characterized in that the curve element (36, 38) has at least one first and at least one second curved path segment (56, 58, 60, 82), the first curved path segment acting in a first axial direction of the intermediate shaft (30) and the second curved path segment acting in a second axial direction of the intermediate shaft (30), characterized in that the tracer member (48, 50, 52, 54) is connected to the striker (26, 28) via at least one spring element (68, 70, 72).

2. The hand power tool of claim 1, characterized in that the striker (26) is supported via the drive shaft (12).

3. The hand power tool of claim 1, characterized in that the striker (26, 28) is supported with a formed-on guide face (64) on a guide face (66) of the drive shaft (12, 14).

4. The hand power tool of claim 1, characterized in that the striker (28) is guided in the drive shaft (14).

5. The hand power tool of claim 1, characterized in that the spring element (68, 70, 72) is formed by a helical compression spring.

6. The hand power tool of claim 1, characterized in that the spring element (68, 70, 72) surrounds the striker (26, 28).

7. The hand power tool of claim 6, characterized in that the spring element (72) is disposed radially inside the tracer member (50, 54) and is braced on a radially inward-pointing collar (74) of the tracer member (50, 54).

8. The hand power tool of claim 1, characterized in that the tracer member (48, 50, 52, 54) is displaceably supported on the striker (26, 28).

9. The hand power tool of claim 1, characterized in that the curve element (36) is formed by a groove.

* * * * *